United States Patent [19]

Vann et al.

[11] 4,040,485

[45] Aug. 9, 1977

[54] METHOD OF SIMULTANEOUSLY SETTING A PACKER DEVICE AND ACTUATING A VENT ASSEMBLY

[75] Inventors: Roy R. Vann; Flint R. George, both of Artesia, N. Mex.

[73] Assignee: Vann Tool Company, Inc., Artesia, N. Mex.

[21] Appl. No.: 648,470

[22] Filed: Jan. 12, 1976

Related U.S. Application Data

[60] Division of Ser. No. 517,390, Oct. 23, 1974, Pat. No. 3,931,855, which is a continuation-in-part of Ser. No. 382,958, July 26, 1973, Pat. No. 3,871,448.

[51] Int. Cl.[2] ..... E21B 33/129; E21B 43/11

[52] U.S. Cl. ..... 166/297; 166/126; 166/315; 166/334

[58] Field of Search ..... 166/315, 297, 126, 128, 166/133, 152, 226, 334

[56] References Cited

U.S. PATENT DOCUMENTS

| | | | |
|---|---|---|---|
| 2,506,680 | 5/1950 | Otis | 166/115 |
| 3,098,526 | 7/1963 | Heron | 166/128 |
| 3,211,228 | 10/1965 | Bramlett | 166/128 |
| 3,211,229 | 10/1965 | Bramlett | 166/128 |
| 3,211,231 | 10/1965 | Bramlett | 166/128 X |
| 3,363,696 | 1/1968 | Berryman | 166/226 |
| 3,457,994 | 7/1969 | Stachowiak | 166/128 X |
| 3,482,628 | 12/1969 | Griffin, Jr. | 166/152 |
| 3,493,052 | 2/1970 | Evans et al. | 166/315 |
| 3,669,190 | 6/1972 | Sizer et al. | 166/315 |

*Primary Examiner*—Stephen I. Novosad
*Assistant Examiner*—George A. Suchfield
*Attorney, Agent, or Firm*—Marcus L. Bates

[57] ABSTRACT

A packer actuated vent assembly comprising a packer device settable by reciprocal movement of a mandrel, a valve actuator in the form of a barrel attached to the packer body, and a mandrel extension having a valve means thereon attached to the packer mandrel. The valve means is engaged by a stop member located on the barrel and is moved to the venting position when the packer mandrel is properly manipulated to seat the packer.

14 Claims, 11 Drawing Figures

X
67
61
64
66
66'
65
30
62
51
57
55
58
54
45
53
75
60"
74
76
68
35
39
42
40
60'
44
35
73
71
70
72
Y

METHOD OF SIMULTANEOUSLY SETTING A PACKER DEVICE AND ACTUATING A VENT ASSEMBLY

REFERENCE TO RELATED APPLICATIONS

This application is a division of Patent Application Ser. No. 517,390, filed Oct. 23, 1974, entitled "Downhole Packer Actuated Vent Assembly", now U.S. Pat. No. 3,931,855, issuing Jan. 13, 1976; which is a continuaton-in-part of parent patent application Ser. No. 382,958, filed July 26, 1973, entitled "Packer Actuated Vent Assembly", now U.S. Pat. No. 3,871,448, issued Mar. 18, 1975.

BACKGROUND OF THE INVENTION

In completing a hydrocarbon producing formation in a deep well, various completion techniques require that a tubing string be attached to a retrievable packer so that a tool string can be suspended from a vent string with the vent string being supported from the retrievable packer. In perforating the hydrocarbon producing formation of a borehole, for example, it has heretofore been necessary to utilize a wireline in order to open the perforated nipple of the vent string so that flow from the completed formation can flow up the tubing annulus into the perforated nipple, and up the production string to the surface of the earth.

In addition to the trip which must be made into the hole with the wireline in order to operate the vent string, it is often necessary to additionally employ a blanking plug in order to enable various other manipulative operations to be safely carried out on the borehole prior to the act of completion. Installation and retrieval of the blanking plug calls for two additional round trips to be made with a wireline operated fishing tool.

Making a trip into a borehole with a wireline is costly as well as dangerous because anything put into the hole is a calculated risk inasmuch as there is always a danger of losing the apparatus and hence a costly fishing job.

Where a conventional wireline operated perforated nipple is employed, there is sometimes more than 12,000 psi pressure differential across the sliding sleeve thereof and for this reason difficulty is often experienced in forcing the sliding sleeve to move to the open position by a wireline operated fishing tool. Moreover, in some well completion techniques, it is often desirable to perforate simultaneously with the opening of the perforated nipple. This expedient is not possible where a wireline is used to manipulate the vent string because a considerable time delay is experienced while the wireline is being removed from the borehole and before the perforating gun can be safely fired.

For these and many other reasons peculiar to well completion and well work-over operations, it is desirable to be able to run a packer downhole with a vent assembly being disposed in underlying relationship respective to the packer, and with the vent assembly supporting various downhole equipment, such as a jet perforating gun. It is desirable that such a vent assembly be actuated by manipulation of the tubing string in a manner whereby the final act of setting the packer also actuates the vent assembly to the opened position thereby enabling a flow path to be immediately established between a production zone and a surface flow line upon perforation of the hydrocarbon bearing formation.

SUMMARY OF THE INVENTION

This invention relates to downhole tools and specifically to a packer actuated vent string. The packer assembly is anchored downhole in a borehole and has a mandrel axially movable relative to the packer body for setting the packer gripping elements against the borehole wall by manipulation of the tubing string to which the mandrel of the packer is connected. The packer body and the packer mandrel each have an extension connected thereto and downwardly depending therefrom. A valve means is connected to provide flow into the mandrel extension. A valve actuating member is connected to the packer body extension for manipulating the valve means when the packer mandrel is moved relative to the packer body.

In the preferred embodiment of the present invention, a sliding valve assembly is sealingly received about a marginal length of the mandrel extension, while a valve actuator projects from the packer body extension, so that when the tubing string in set down, the mandrel telescopes in a downward direction thereby enabling the valve actuator to engage the valve means and move the valve into the flow permitting configuration.

In another form of the invention, biasing means are provided for rapidly opening th valve means to the fully-opened position whenever the tubing string is moved a sufficient amount.

A primary object of the present invention is the provision of a packer actuated vent assembly which can be moved to the flow conducting configuration by manipulation of apparatus associated with the packer.

Another object of the invention is to provide a packer actuated vent assembly comprised of a retrievable packer having the vent assembly disposed thereunder so that manipulation of the tubing string to which the packer is connected causes the vent assembly to be moved to the open position.

A further object of this invention is to disclose and provide a means by which a permanent completion well bore apparatus can be run downhole into the borehole while the tubing string of the apparatus is utilized to set a packer apparatus and at the same time to open a vent string underlying the packer means.

A still further object of this invention is to provide a new combination of elements comprised of a well bore packer and a tubing vent string connected together in a manner whereby manipulation of the tubing string in setting the packer also causes the vent string to be moved to the flow conducting configuration.

Another and still further object of this invention is to provide a method for completing a hydrocarbon bearing formation wherein the formation can be perforated immediately following setting of the packer and the act of setting the packer is utilized for opening the vent string.

An additional object of the present invention is to provide a method of opening a vent string located downhole in a borehole by utilizing the action of setting a packer to cause the valve to be rapidly moved to the fully opened position.

The obove objects of the invention are attained by the provision of a combination of elements and a method for use with apparatus fabricated in a manner substantially as described in the above abstract and summary.

These and various other objects and advantages of the invention will become readily apparent to those skilled in the art upon reading the following detailed description and claims and by referring to the accompanying drawings.

DETAILED DESCRIPTION OF THE INVENTION

Figure 1:
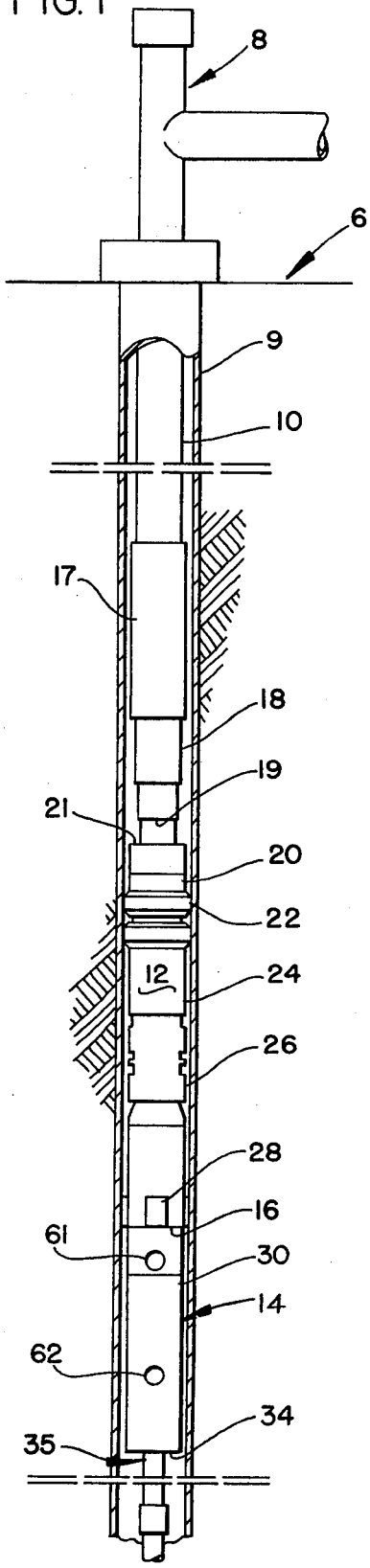
FIG. 1 is a diagramatical representation of a cross-section of the earth disclosing a tool string located within a well bore with apparatus made in accordance with the present invention being connected into the tool string.

In FIG. 1 there is schematically disclosed a surface area of the ground 6 having a wellhead 8 extending thereabove and connected to a cased borehole 9. Within the borehole there is located a tubing string 10 from which a packer 12 is suspended. A packer actuated vent assembly 14, made in accordance with the present invention, is connected to the packer.

The packer can take on any number of different forms so long as it is provided with a hollow mandrel for flow conducting fluid axially therethrough, and so long as the mandrel is reciprocated relative to the packer body while the packer elements thereof are being set. As for example,, a Baker Lok-Set retrievable casing packer, product No. 646-12 page 498, Baker Oil Tool 1970-71 catalog, Baker Oil Tools, Los Angeles, Cal. Other packer apparatus which can be used with the present invention are exexmplified by the patent to Brown U.S. Pat. No. 2,893,492, or Keithahn, U.S. Pat. No. 3,112,795.

Figure 2:
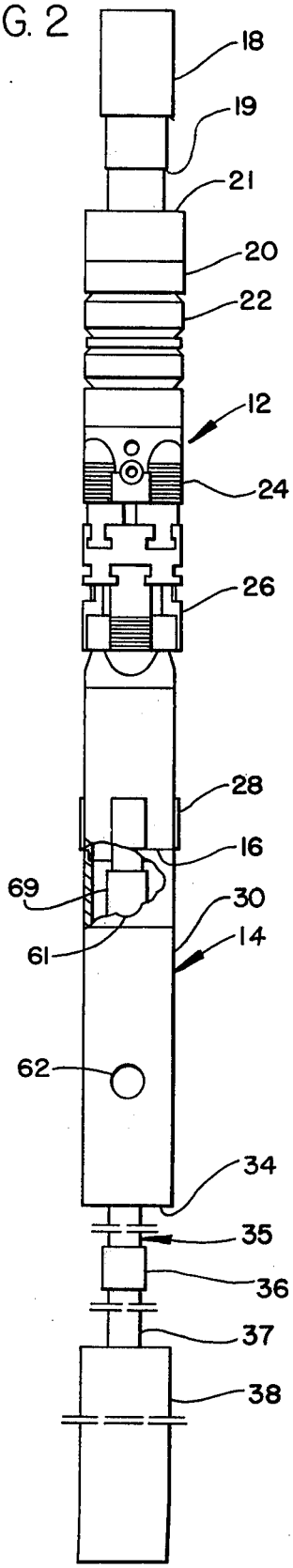
FIG. 2 is an enlarged, broken, side elevational view of part of the tool string disclosed in FIG. 1.

As illustrated in FIG. 2, in conjunction with some of the remaining FIGURES of the drawings, interface 16 defines a threaded connection effected by the lower threaded marginal terminal end of the packer body and the upper threaded marginal terminal end of the vent assembly. Sub 17 of FIG. 1 is attached to coupling member 18 of the mandrel of the packer so that the packer of FIG. 2 can be series connected and supported by the illustrated tubing string. The lower edge portion 19 of the mandrel coupling is movable toward the upper body portion 20 of the packer until the lower edge portion 19 abutingly engages an upper edge portion 21, as the packer rubbers 22 are set within the casing in the usual manner. Radially disposed slips 24 and 26 are forced in an outward direction either by rotation of the mandrel or by the initial downward movement of the mandrel, depending upon the details of design thereof, so as to anchor the packer device to the interior surface of the casing wall. Drag blocks 28 discourage movement of the packer body relative to the casing so that the mandrel can be manipulated to set the slips and the packer element.

The vent assembly 14 of the present invention comprises a cylindrical barrel 30 having radially spaced apart apertures 61 and 62 formed intermediate the downwardly opening peripheral edge portion 34 and the interface 16. The lower marginal end of a mandrel extension 35 threadedly engages a sub or coupling 36 for connection of the vent assembly into a lower pipe string 37 so that a jet gun 38 or the like can be run downhole into the borehole and positioned adjacent to a hydrocarbon containing formation when it is desired to complete the well, as pointed out in my issued U.S. Pat. No. 3,706,344, for example.

Figure 3:
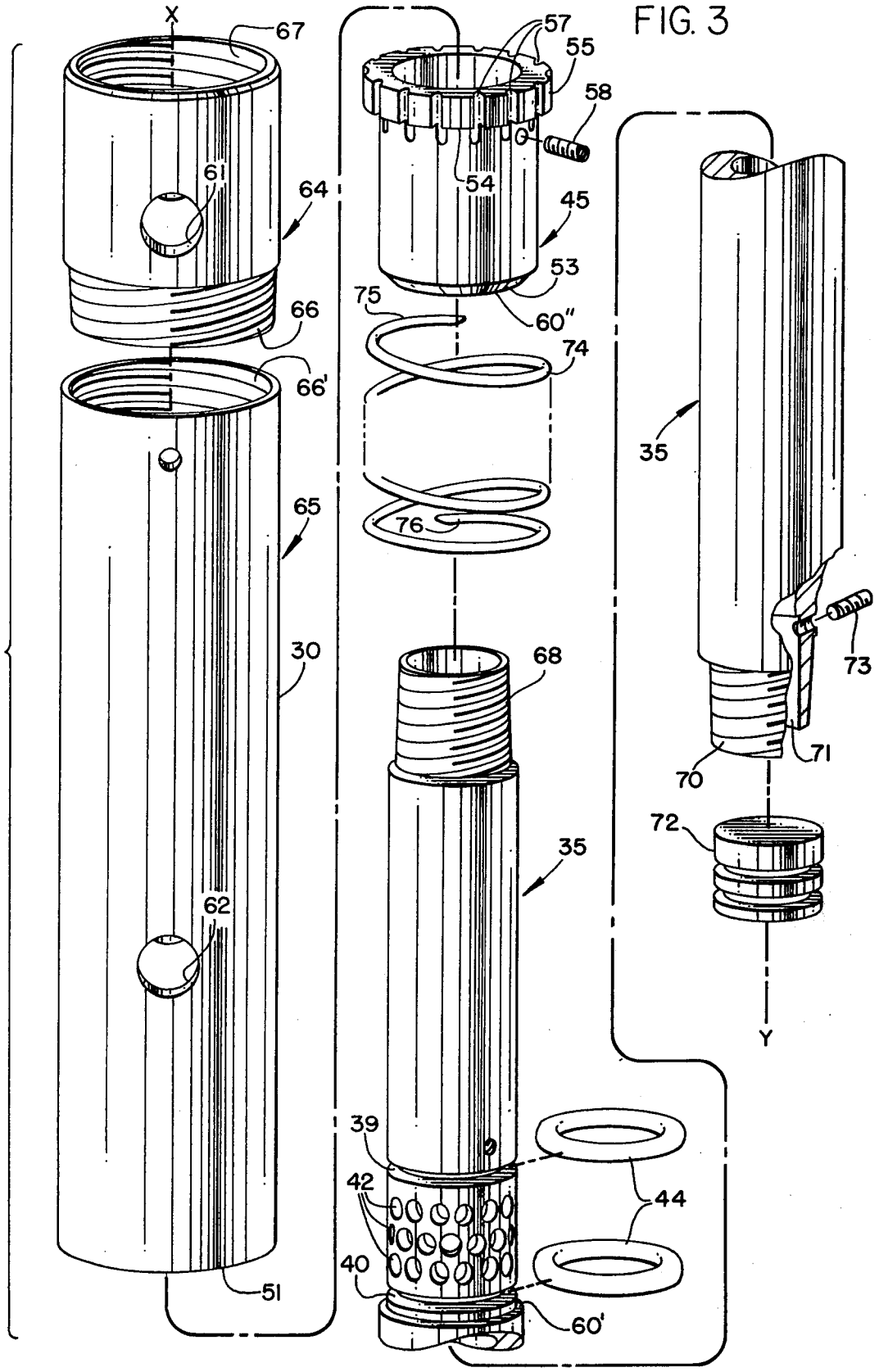
FIG. 3 is an enlarged, exploded view which discloses the components of the present invention.
Figure 7:
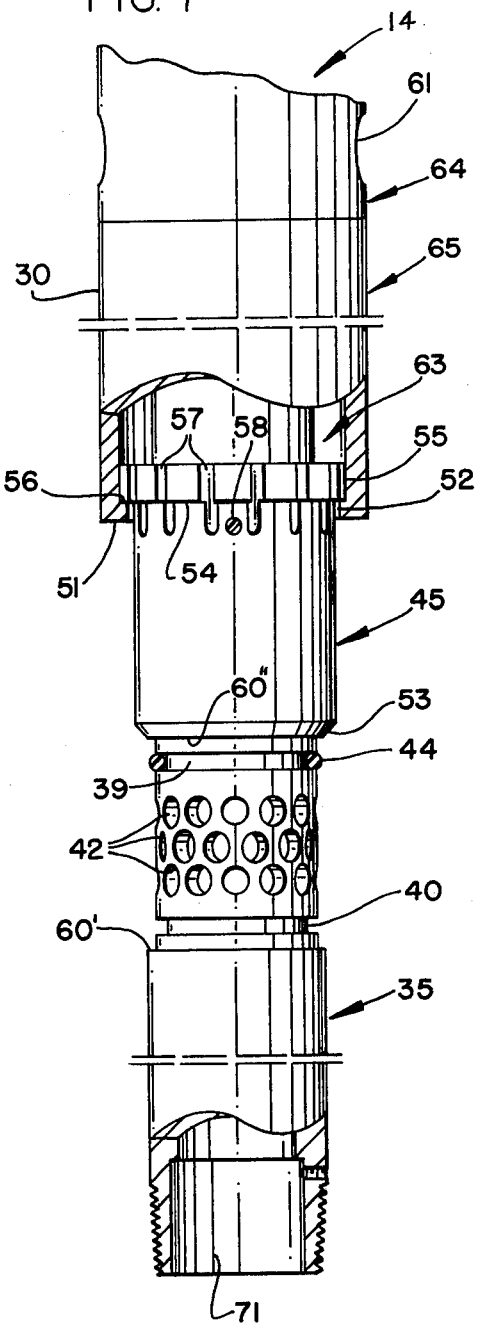
FIG. 7 is a fragmentary, part cross-sectional view of a tool made in accordance with the foregoing FIGURES, but with the tool being actuated into the opened position.

Looking now to the details of the embodiment of the invention disclosed in FIGS. 3 and 7, in conjunction with various ones of some of the remaining FIGURES, the mandrel extension is seen to be provided with spaced parallel circumferentially extending o-ring receiving grooves 39 and 40 formed in a marginal exterior wall surface thereof. A flow port in the form of a plurality of radially spaced apart apertures 42 is formed through the wall of the mandrel at a location intermediate the spaced grooves.

The valve means includes a cylindrical sleeve which forms a sliding valve element 45. The valve element can be provided with a close tolerance inside peripheral surface 46 for sealingly and slidably engaging a marginal circumferentially extending length of the mandrel in proximity to the flow port. It is preferred, however, to employ spaced seal means in the form of o-ring 44 or Chevron seals which are placed within grooves 39 and 40, raather than relying upon a close tolerance sliding seal.

Figure 4:
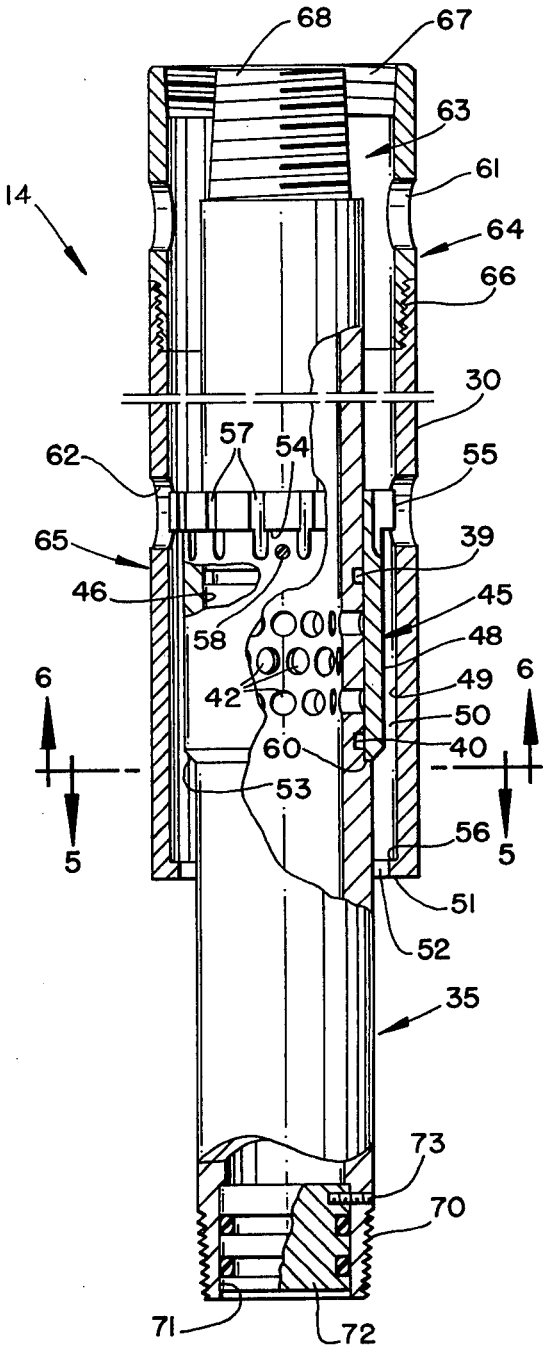
FIG. 4 is an enlarged, part cross-sectional elevational view of the present invention.
Figure 5:
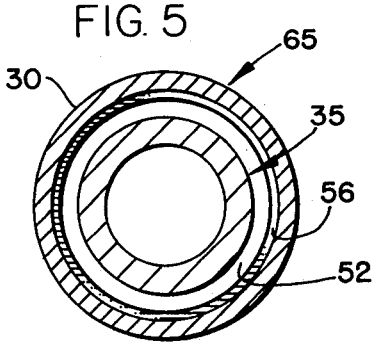
FIGS. 5 and 6, respectively, are cross-sectional views taken along line 5—5 and line 6—6, respectively, of FIG. 4.
Figure 6:
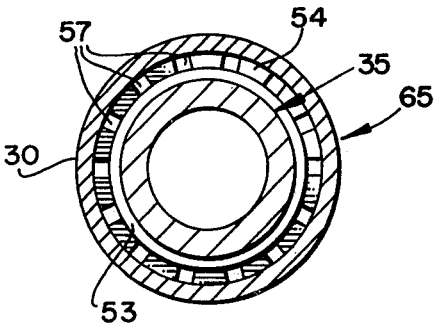

As best seen in FIG. 4, the outer peripheral wall surface 48 of the sliding valve element is spaced inwardly from the interior surface 49 of the valve actuator a sufficient amount to form an annulus 50 therebetween. The lowermost marginal terminal end of the valve actuator is inwardly turned at 51 and spaced from the mandrel an amount indicated by the numeral 52 so that shoulder 54 of enlargement 55 of the sliding valve element will engage and be moved by a shoulder 56 of the valve actuator. The inturned portion 51 is of a size to be freely received within annulus 50 when the leading edge portion 53 of the sliding valve element is extended therethrough.

The enlargement 55 is provided with a series of longitudinally disposed cutouts 57 to preclude a substantial pressure drop being effected thereacross. Shear pin 58 releasably secures the valve element to the mandrel extension with sufficient force to preclude inadvertent relative movement therebetween, as well as providing a positive weight change indication upon shearing.

Interface 60 defines the abutting shoulders which are also illustrated in FIG. 3 as being formed at 60 on the valve element and at 60' on the mandrel so that the mandrel can be positively and properly positioned in sealed relation respective to flow ports 42.

Inspection ports 61 and 62 enable the interior of the vent assembly to be viewed, as well as assuring that unrestricted fluid flow occur within annulus 63.

The valve actuator preferably is comprised of two members 64 and 65 which threadedly engage one another at 66 so that the illustrated straight threaded surface can be utilized to adjust the relative distance between shoulder 54 and 56. The threaded marginal end 67 threadedly engages the lower threaded marginal end of the packer body as illustrated in various ones of the FIGURES.

Opposed marginal end portions 68 and 70 of the mandrel extension are threaded so that end 68 can be affixed to the packer mandrel by means of the sub 69 as seen illustrated in FIG. 2. The lower marginal end of the mandrel extension is threaded at 70 for threadedly engaging the coupling 36. The marginal inside peripheral wall surface of the mandrel extension is reamed at 71 to provide for close tolerance sealing engagement with piston 72. Shear pin 73 prevents the piston from being inadvertently dislodged from its illustrated seat.

In FIG. 7 it will be noted that the mandrel extension has been moved in a downward direction as a result of relative movement imparted between the packer body and the packer mandrel so that shoulder 56 of lip 51 has engaged shoulder 54 of enlargement 55 of the sliding valve element, causing pin 58 to shear as a result of movement of the sliding valve element to the opened position. Hence, the valve in FIG. 7 is in the open position while the valve in FIG. 4 is in the closed position. Fluid now is free to flow into the flow port 42, into the interior of the hollow mandrel, and to the surface of the ground. It will further be noted in FIG. 7 that pin 73 has been sheared as a result of piston 72 being removed from the lower interior marginal end portion of the mandrel extension.

Figure 8:
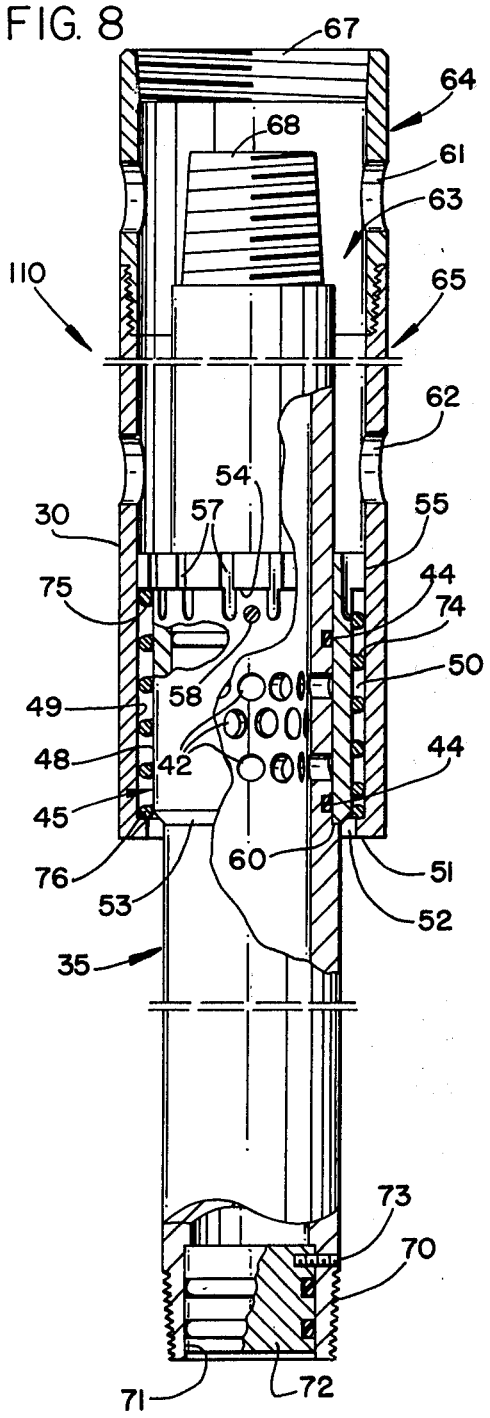
FIG. 8 is a cross-sectional view similar to FIG. 4, but showing a second embodiment of the invention.

In the embodiment 110 of FIG. 8, biasing means 74, biases the sliding valve element 45 toward the packer body. The biasing means preferably is a fully collapsible coil spring which may be square or round in configuration and which preferably is placed with each free end portion thereof in abutting engagement with the in-turned lip 51 and shoulder 54. As seen in the drawings, end portion 75 of the spring abuttingly engages shoulder 54 of enlargement 55 while end portion 76 abuttingly engages shoulder 56 of in-turned lip 51.

Figure 10:
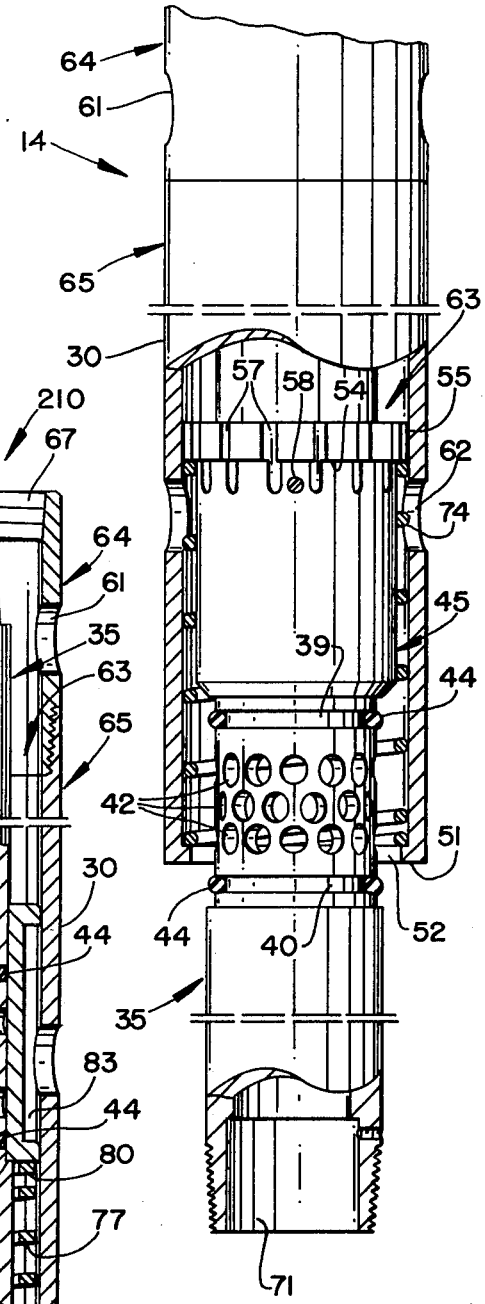
FIG. 10 is a fragmentary, part cross-section view of the tool of FIGS. 8 and 9, but with the valve of the tool being in the opened configuration; and, FIG. 11 discloses a modification of the tool seen in FIGS. 8–10.

As disclosed in FIG. 8, shear pin 58 prevents the action of spring 74 from moving the sliding valve element from the illustrated closed position of FIG. 8 to the illustrated opened position seen in FIG. 10.

Figure 9:
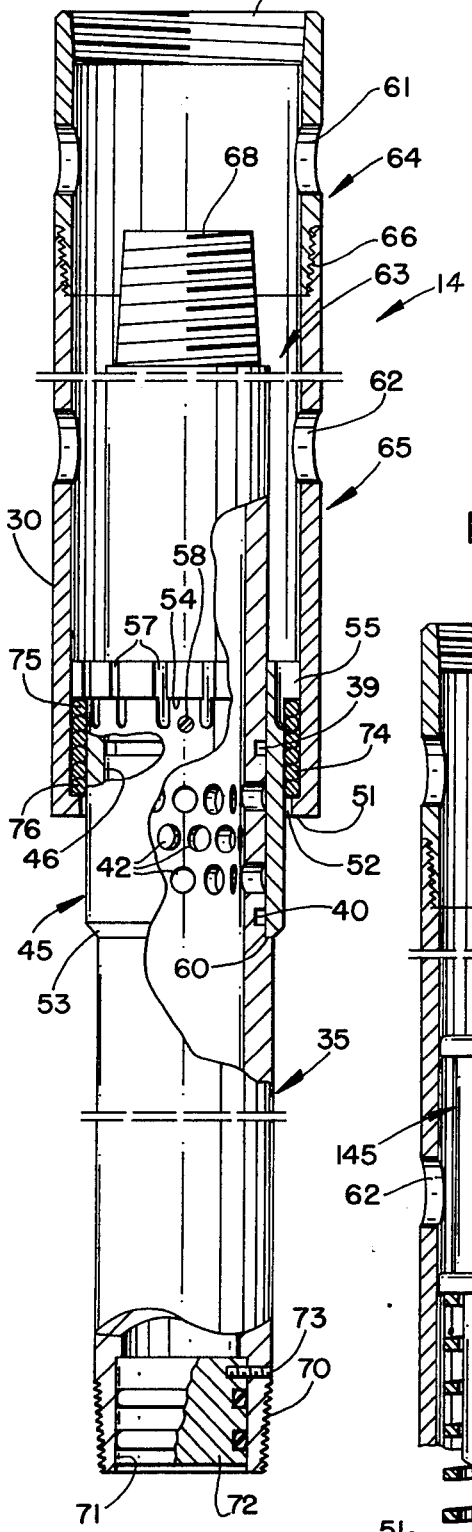
FIG. 9 is a broken, part cross-sectional view which illustrates the tool of FIG. 8 while it is being manipulated into the opened position.

In FIG. 9, spring 74 is fully compressed so that each convolution of the spring presses against itself with the opposed ends 75 and 76 of the spring being compressed between shoulders 54 and 56. As the relative movement between the packer body and mandrel imparts additional relative movement between the mandrel extension and the valve actuator, the pin 58 will shear, thereby forcing enlargement 55 to move respective to lip 51 into the illustrated position of FIG. 10 wherein the valve is shown in the fully opened position.

Figure 11:
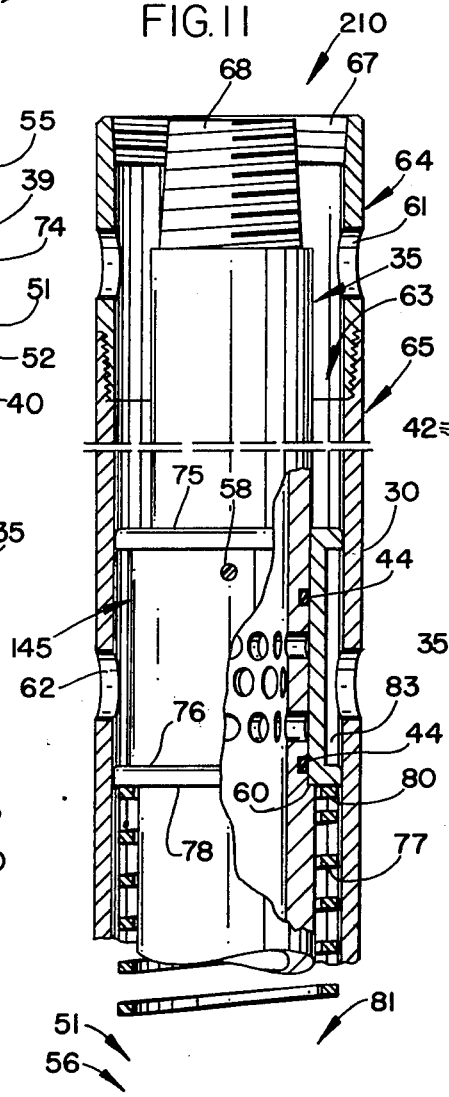

In the embodiment 210 disclosed in FIG. 11, the sliding valve element 145 is provided with spaced enlargements 75 and 76 which define the length of the element. The sliding valve element cooperates with the mandrel in sealed relationship therewith as in the before described embodiments of the invention.

Heavy square coiled spring 77 is interposed between the lowermost edge portion 78 of the element 145 and the shoulder 56 formed on the in-turned lip 51 of the lowermost portion of the valve actuator.

Opposed ends 80 and 81 of the spring are spaced sufficiently far enough apart to impart adequate force into the sliding valve element so that when shear pin 58 releases the element, it will be moved toward the packer and uncover the flow port.

In the operation of the first embodiment, the packer actuated vent assembly is assembled by sliding element 45 over the mandrel extension 35 and thereafter securing it in sealed position with shear pin 58. Pin end 68 is threadedly engaged with the lower threaded marginal end portion of the packer mandrel by utilizing a coupling 69 of a proper length.

The valve actuator is threadedly engaged at 67 with the lower marginal outer surface area of the threaded packer body in the general area underlying the drag blocks thereof. It is necessary to form the recited threads on the packer body. Threads 66 are adjusted so that the enlargement 55 appears to be centered in window 62, thereby positioning al of the relatively moving parts so that the apparatus will function properly when manipulated by the upper tubing string.

The piston 72 is employed where it is desired to keep the interior of the tubing dry for one reason or another. Where the packer is run into the hole with apparatus 36–38 suspended therebelow, the piston 72 may be dispensed with if required.

The J is unlatched in the usual manner, the packer set down so that the anchors engage the casing wall, and as continued downward motion of the tubing string causes the packing elements to expand into sealed relationship respective to the casing wall, shoulder 54 will be moved by the mandrel extension into abutting engagement with shoulder 56 of lip 51, thereby slidably moving the sliding valve element from the illustrated position of FIG. 4 into the illustrated position of FIG. 7. The shear pin 58 must part during this operation.

In the second embodiment of the invention, the length of the valve actuator must be extended a distance equal to the height of the fully collapsed spring 74 so that the previous operation will be applicable to this embodiment of the invention.

As the tubing string is set down to pack off the borehole, shoulder 56 of lip 51 engages the coiled spring 74 which in turn engages shoulder 54 of enlargement 55 thereby shearing pin 58 and springingly moving the sliding valve element in a biased manner into the opened position seen illustrated in FIG. 10.

Where deemed desirable the relationship of the valve actuator, sliding valve element, mandrel extension, and spring can be that as seen illustrated in FIG. 9. However, there is danger of shearing pin 58 should the adjustment provided at 66 be improper.

In the embodiment of FIG. 11, a fully collapsible spring 77, square in cross-sectional configuration, is interposed between the bottom-most edge portion 78 of the sliding valve element, with the remaining end 81 of the spring being abuttingly received against shoulder 56 of inturned lip 51 of the valve actuator. When the tubing string is set down to pack off the borehole, spring 77 fully collapses and shears pin 58, thereby moving the element into the open position respective of the flow ports.

I claim:

1. The method of completing a well bore comprising the steps of:

assembling a tool string comprised of a tubing string, a packer device, and a vent assembly; attaching the vent assembly in underlying relation respective to the packer device and attaching the packer device to one end of the tubing string;

connecting an extension from the packer mandrel to the vent assembly and moving the vent assembly from the closed to the opened position in response to said packer mandrel being moved from the unset to the set position;

running the tool string downhole into the borehole such that both the packer device and vent assembly are positioned at a location which is above a production formation associated with the well bore, with the tubing string extending from the well head down to the packer device;

setting the packer device while simultaneously actuating the vent assembly to the opened configuration so that flow can occur up the lower borehole annulus, into the vent assembly, into the tubing string, and out of the well head.

2. The method of claim 1, and further, including the step of:

releasably holding said vent assembly in the closed position while biasing said vent assembly towards the opened position, so that when said packer is set, said vent assembly rapidly assumes the opened position.

3. The method of claim 2 and further including the step of:

attaching a perforating gun means in an underlying position respective to said vent assembly, and detonating said gun after said vent assembly has been moved to the opened position.

4. The method of claim 3, and further including the step of:

achieving an open position of said vent assembly by arranging a sliding valve element about said mandrel extension, and moving said sliding valve element with said extension.

5. The method of claim 1, and further including the step of:

attaching a perforating gun means in an underlying position respective to said vent assembly, and detonating said gun after said vent assembly has been moved to the opened position.

6. The method of claim 1, and further including the step of:

achieving an open position of said vent assembly by arranging a sliding valve element about said mandrel extension so as to prevent flow therethrough, and moving said sliding valve element with said extension so as to permit flow therethrough.

7. The method of claim 1, and further including the steps of:

achieving an open position of said vent assembly by arranging a sliding valve element about the mandrel which is moved to permit flow therethrough;

releasably holding said valve element in the closed position while biasing said valve element towards the opened position, so that when said packer is set, said vent assembly rapidly assumes the opened position;

attaching a perforating gun means in an underlying position respective to said vent assembly, and detonating said gun after said vent assembly has been moved to the opened position.

8. Method of simultaneously setting a packer device and actuating a vent assembly to the opened configuration, comprising the steps of:

attaching a vent assembly in underlying relationship respective to a packer device, and attaching the packer device to the end of a tubing string; forming an inlet port into the vent assembly so that flow can occur thereinto; precluding flow into said vent assembly by placing a closure means about said inlet port thereof;

running the packer device into a borehole by using the tubing string, with the vent assembly being supported in underlying relationship relative thereto;

setting the packer device by manipulation of the tubing string;

opening the vent assembly by using the relative movement between the tubing string and the packer to move said closure means to the opened position so that a flow path is formed from the lower borehole, into the vent assembly, up through the packer device, and into the tubing string.

9. The method of claim 8 wherein the packer device has a hollow mandrel which is moved to set the packer rubbers.

10. The method of claim 8 and further including the step of:

releasably holding said vent assembly in the closed position while biasing said vent assembly towards the opened position, so that when said packer is set, said vent assembly rapidly assumes the opened position.

11. The method of claim 8 and further including the step of:

attaching a perforating gun means in an underlying position respective to said vent assembly, and detonating said gun after said vent assembly has been moved to the opened position.

12. The method of claim 8 and further including the step of:

achieving an open position of said vent assembly by arranging a sliding valve element about said mandrel extension which can be moved from an opened into a closed position, and using said relative movement to move said sliding valve element to the opened position.

13. Method of simultaneously setting a packer device and actuating a vent assembly to the opened configuration, comprising the steps of:

attaching a vent assembly in underlying relationship respective to a packer device, and attaching the packer device to the end of a tubing string;

running the packer device into a borehole by using the tubing string, with the vent assembly supported in underlying relationship relative thereto;

seatting the packer device by manipulation of the tubing string;

opening the vent assembly by using the relative movement between the tubing string and the packer so that a flow path is formed from the lower borehole, into the vent assembly, up through the packer device, and into the tubing string;

releasably holding said vent assembly in the closed position while biasing said vent assembly towards the opened position, so that when said packer is set, said vent assembly rapidly assumes the opened position.

14. Method of simultaneously setting a packer device and actuating a vent assembly to the opened configuration, comprising the steps of:

attaching a vent assembly in underlying relationship respective to a packer device, and attaching the packer device to the end of a tubing string;

running the packer device into a borehole by using the tubing string, with the vent assembly being supported in underlying relationship relative thereto;

setting the packer device by manipulation of the tubing string;

opening the vent assembly by using the relative movement between the tubing string and the packer so that a flow path is formed from the lowr borehole, into the vent assembly, up through the packer device, and into the tubing string;

attaching a perforating gun means in an underlying position respective to said vent assembly, and detonating said gun after said vent assembly has been moved to the opened position.

* * * * *